US005759343A

United States Patent [19]

Roberts

[11] Patent Number: 5,759,343

[45] Date of Patent: Jun. 2, 1998

[54] TAPING GUN MUD PUMP APPARATUS

[76] Inventor: David Lynn Roberts, 10340 Alta Vista Rd., Keller, Tex. 76248-6500

[21] Appl. No.: 812,440

[22] Filed: Mar. 6, 1997

Related U.S. Application Data

[63] Continuation of Ser. No. 516,745, Aug. 18, 1995, abandoned.

[51] Int. Cl.[6] ..... B05C 9/00

[52] U.S. Cl. ..... 156/578; 156/575

[58] Field of Search ..... 156/575, 578, 156/577, 523, 524; 118/410, 411

[56] References Cited

U.S. PATENT DOCUMENTS 3,707,427 12/1972 Erickson ..... 156/575

5,107,788 4/1992 Boldrini et al. ..... 118/212

5,230,608 7/1993 Januska ..... 156/578 X

*Primary Examiner*—James Engel

*Attorney, Agent, or Firm*—Arthur F. Zobal

[57] ABSTRACT

A container is provided for holding taping mud. A progressive cavity rotary drive pump is located in the container and secured to the bottom of the container. The pump has an inlet in the container and an outlet. An outlet member is secured to the pump outlet and extends through the container on one side and has an outlet end extending upward. The pump has a rotary drive shaft for operating the pump. A rotary shaft is coupled to the drive shaft and extends through the container wall on an opposite side. An electrically operated drive is provided for operating the pump for pumping mud from the container into the taping gun when its inlet is coupled to the outlet end of the outlet member.

8 Claims, 3 Drawing Sheets

TAPING GUN MUD PUMP APPARATUS

This is a continuation of application Ser. No. 08/516,745 filed Aug. 18, 1995 now abandoned.

BACKGROUND OF THE INVENTION

1. Field of the Invention

The invention relates to an apparatus for pumping taping mud into a taping gun.

2. Description of the Prior Art

U.S. Pat. No. 4,090,914 discloses a hand pump for pumping taping mud from a reservoir into a taping gun. This system has been used for a number of years, however, it takes about 15 seconds to fill a taping gun which is too slow.

SUMMARY OF THE INVENTION

It is an object of the invention to provide an apparatus for pumping taping mud from a reservoir or container into a taping gun at a much faster rate than the hand pump systems used in the past.

The apparatus comprises a pump having a fluid inlet, a fluid outlet, and a rotary drive which when rotated causes fluid to flow into the inlet and out of the outlet. The pump is secured in the bottom of a container or reservoir with the pump outlet coupled to an outlet member extending through container wall on one side of the container and having an outlet end extending upward. The rotary drive extends through the container wall on the opposite side of the container wall. An electrically actuated drive means is provided for rotating the rotary drive.

DESCRIPTION OF THE PREFERRED EMBODIMENT

Figure 1:
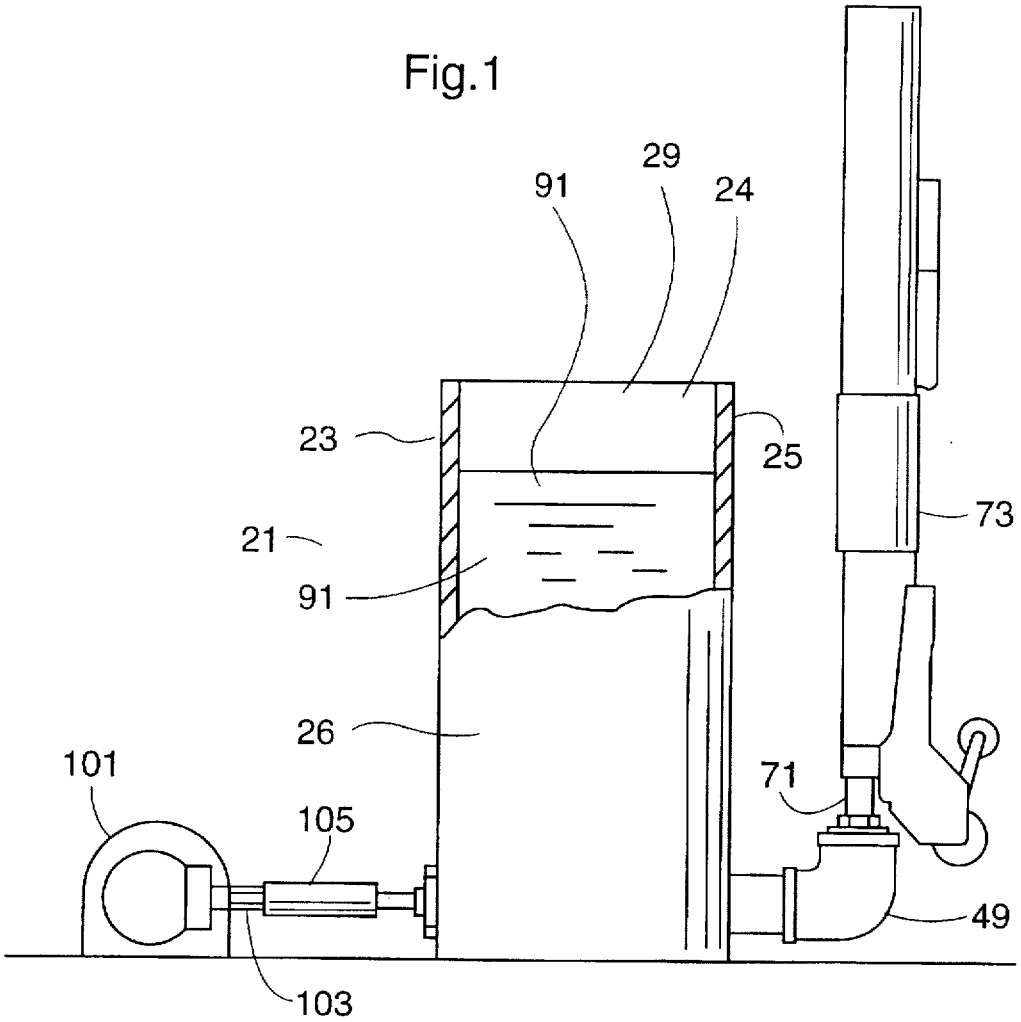
FIG. 1 is a side view of the apparatus of the invention with a taping gun coupled to the outlet.
Figure 2:
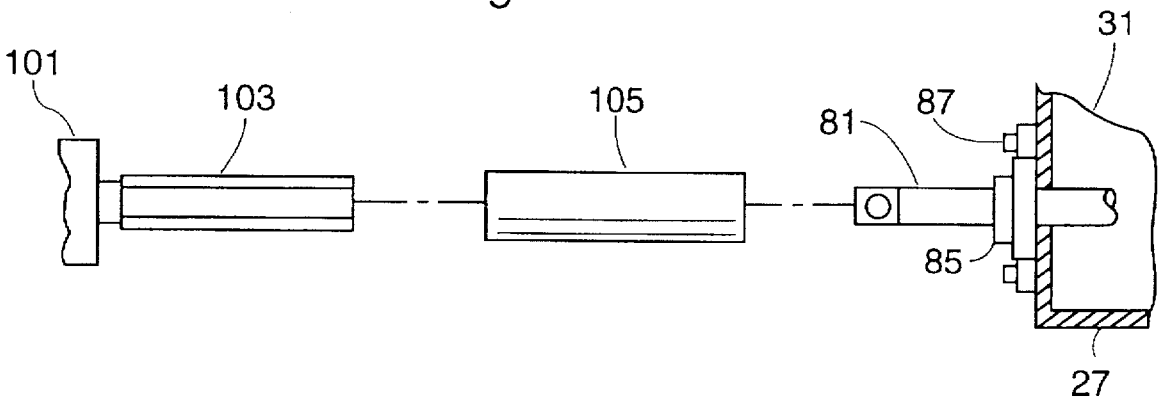
FIG. 2 is an exploded view of the rotary drive of the rotary pump of the apparatus with a coupling means for coupling the drive shaft of an electrically operated motor to the rotary drive.
Figure 3:
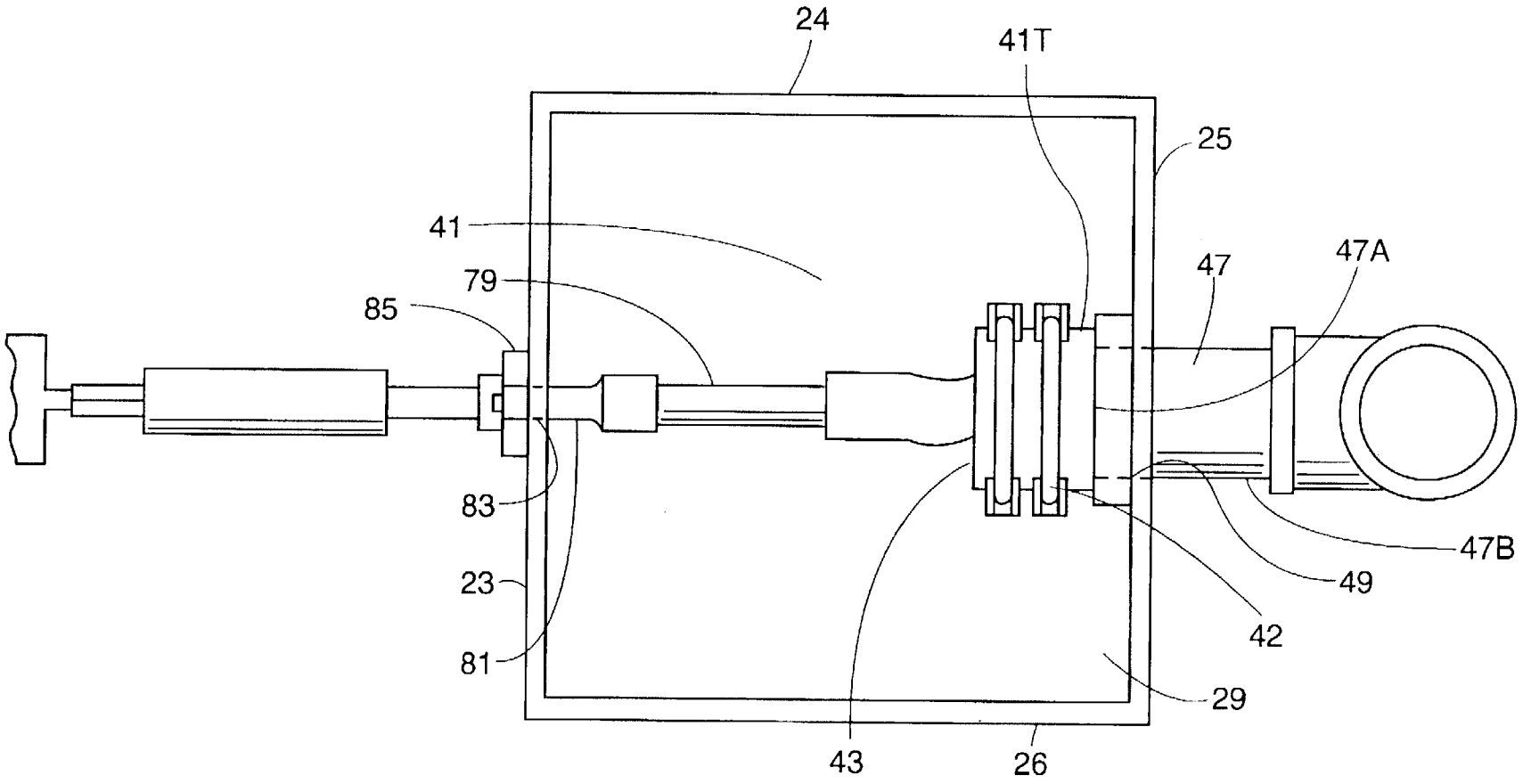
FIG. 3 is a top plan view of the apparatus of the invention.
Figure 4:
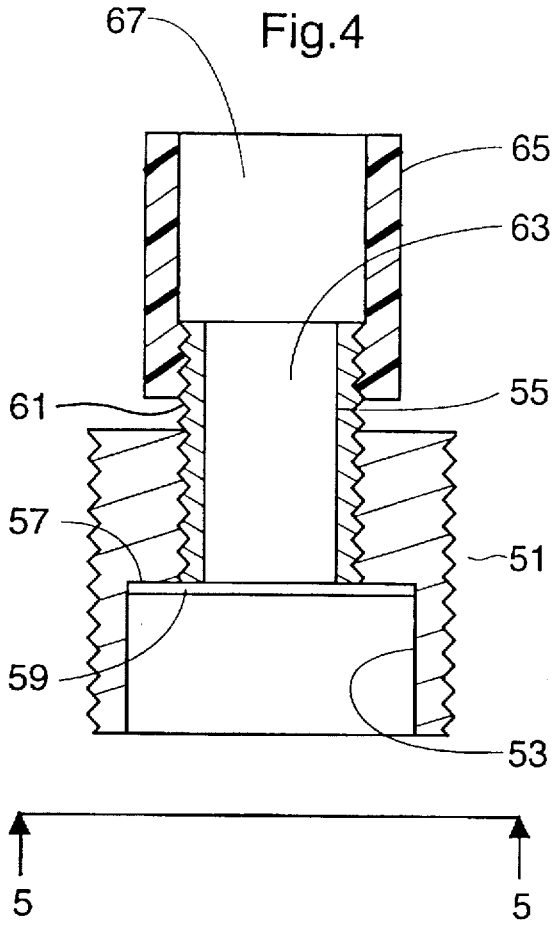
FIG. 4 is a cross-sectional view of the top portion of the outlet member located on the outside of the container.
Figure 6:
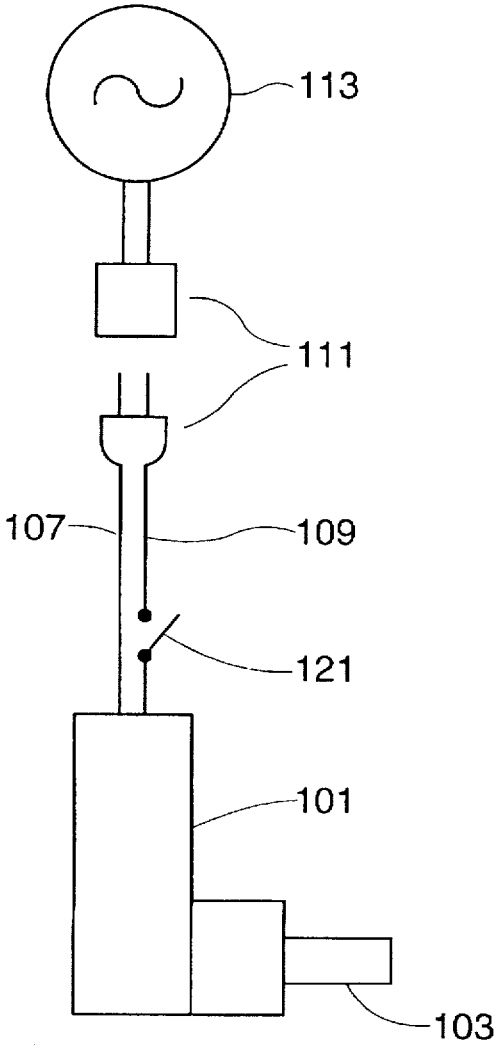
FIG. 6 illustrates an electrically operated device including an electric motor for use for rotating the rotary pump.
Figure 5:
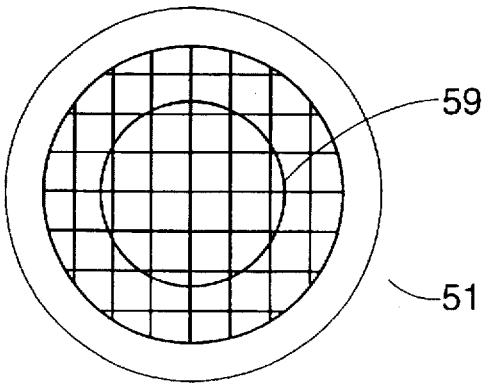
FIG. 5 is a view of FIG. 4 as seen from lines 5—5 thereof.

Referring now to the drawings there is shown a container or reservoir 21 having a four side walls 23, 24, 25, and 26, a bottom wall 27 and an upper opening 29 leading to the interior 31 of the container 21. A rotary pump 41 is located in the container and secured to the bottom wall 29. The pump 41 has a stator tube 41T with an inlet at 43 and an outlet 47 which extends through an aperture 49 formed through the wall 25. U-bolts 42 are located around the stator tube 41T and extend through holes formed through the container bottom wall 27 and are secured in place by bolts. Seals are formed between the arms of the U-bolts and the bottom wall 27 to prevent leakage of the taping mud through the holes. A seal not shown, is provided to form a seal between the outlet 47 and the wall 25 of the container to prevent leakage of taping mud 91 through the aperture 49. The outer end 47B of the outlet 47 is secured to an elbow 49. A fitting 51 is screwed into the top end of the elbow 49. The fitting 51 has a large aperture 53 and a smaller threaded aperture 55 extending therethrough with a shoulder 57 formed between the apertures 53 and 55. A filter or screen 59 is located in the aperture 53 against the shoulder 57. A threaded fitting 61 with an aperture 63 extending therethrough is screwed in the aperture 55. A flexible hose 65 with an aperture 67 extending therethrough is secured to the fitting 61. The elbow 49, fittings 51, 61, and hose 65 extend upward to allow the inlet 71 of a taping gun 73 to be fitted into the upper end of the hose 65. The taping gun 73 is of the type disclosed in U.S. Pat. No. 4,090,914 which is incorporated herein by reference.

The other end of the pump 41 has a connecting rod shaft 79. A drive shaft 81 is connected to the shaft 79 and extends through an aperture 83 formed through the wall 23. Member 85 is an annular bearing through which the shaft 81 extends. The bearing 85 is secured to the wall 23 by bolts 87. A seal, not shown is provided to form a seal between the bearing, shaft 81 and the wall 23 to prevent the leakage of taping mud 91 through the aperture 83.

A electrical grinder 101 (having an electrically operated motor) with a rotatable hex rod 103 is provided for rotating the shaft 81, 79 by way of a hollow coupling member 105 which can removably couple the rod 103 to the shaft 81. The grinder 101 is operated by A.C. voltage. Other types of suitable AC electric motors may be used to rotate the shaft 81 and hence the shaft 79 to operate the pump 41. A switch 121 is provided in one of the electrical leads 107 and 109. Member 111 is a plug for connecting leads 107 and 109 to an A.C. source 113. Switch 121 is normally open. It can be located on the floor and closed by stepping on the switch with ones foot.

In using the system, taping mud 91 is located in the container 21 and rod 103 is coupled to shaft 81 by coupling member 105 and the plug 111 is coupled to the A.C. source 113. When the taping gun 73 becomes empty, the gun inlet 71 is inserted in the hose 65 and the operator steps on the switch to operate the pump 41 to pump a fresh supply of taping mud in the gun 73. In one embodiment, the pump 41 is a progressive cavity pump. The progressive cavity pump is a commnercially available pump sold by Robbins Myers and identified as model No. 2L3. The length of the pump was cut in half. The container 21 is 12 inches by 12 inches with a height of 16 inches. The container serves as the inlet of the pump. The grinder motor is capable of rotating its hex rod 103 at 6000 rpm without a load. The hex head is a 13/16 hex member. Using this system, the taping gun can be filled in 3 to 5 seconds which is much faster than the 15 seconds that is required to fill the gun using a hand pump. The taping mud may be formed of a mixture of water and an all purpose joint compound produced by USG. The compound comprises dolomite CAS 16389-88-1 or limestone CAS 1317-65-3, water CAS 7732-18-5, Talc CAS 14807-96-6, mica CAS 12001-26-2, and vinyl acetate polymer CAS 9003-20-7 or ethylene vinyl acetate polymer CAS 24937-78-8.

I claim:

1. An apparatus for loading taping mud into a taping gun of the type having an elongated body with a relatively short inlet at one end and which inlet extends generally in the same direction as that of the length of the body such that the short inlet extends downward when said one end is located in a downward position, comprising:

a container having a bottom end with a bottom wall and a surrounding side wall with an upper end defining an upper opening leading into the interior of the container, said bottom end being adapted to support said container in a support position to receive and hold a fluid in the interior thereof, a pump having a fluid inlet, a fluid outlet, and a rotary drive which when rotated causes fluid to flow into said inlet and out of said outlet, an outlet member extending through said side wall near said bottom wall on one side of said container and having an outlet end located outside of said container and extending upward to a level below said upper end for receiving the inlet of the taping gun when said container is in said support position, said level of said outlet end being located closer to the level of said bottom wall of said container than to the level of said upper end, said outlet end in combination with said container being strong enough to support the weight of the taping gun when its said inlet is received by said outlet end, said pump being located and secured in said container near said bottom wall with said pump inlet being located in said container and with said pump outlet coupled to said outlet member, said rotary drive extending through said side wall on a side of said container opposite said one side.

2. The apparatus of claim 1, comprising:

an electrically actuated drive means for rotating said rotary drive.

3. The apparatus of claim 2, comprising:

a switch coupled to said drive means for connecting and disconnecting electrical power to and from said drive means, said switch being located relatively close to said container such that a person supporting the taping gun with its inlet received in said outlet end may actuate and deactuate said switch for connecting and disconnecting electrical power to and from said drive means.

4. The apparatus of claim 3, wherein:

said bottom wall has an area about the size of the cross sectional area of said upper opening.

5. The apparatus of claim 3, wherein:

said pump comprises a progressive cavity pump.

6. The apparatus of claim 4, wherein:

said pump comprises a progressive cavity pump.

7. The apparatus of claim 6, wherein:

said pump when operated, pumps the mud at the bottom of said container laterally outward and then upward by way of said pump inlet and outlet and said outlet member.

8. The apparatus of claim 1, comprising:

a filter located in said outlet end.

* * * * *